United States Patent [19]

Glomeau

[11] Patent Number: 4,766,728

[45] Date of Patent: Aug. 30, 1988

[54] FLOW MATCHING VALVE AND HYDRAULIC SYSTEM EMPLOYING SAME

[75] Inventor: J. Robert Glomeau, Dover, Mass.

[73] Assignee: Rexa Corporation, Dover, Mass.

[21] Appl. No.: 101,688

[22] Filed: Sep. 28, 1987

Related U.S. Application Data

[63] Continuation-in-part of Ser. No. 674,537, filed as PCT US84/00448 on Mar. 22, 1984, published as WO84/03916 on Oct. 11, 1984, Pat. No. 4,696,163, which is a continuation-in-part of Ser. No. 479,672, Mar. 28, 1983, Pat. No. 4,557,180, and a continuation-in-part of Ser. No. 479,673, Mar. 28, 1983, Pat. No. 4,625,513.

[51] Int. Cl.[4] ..... F15B 7/00

[52] U.S. Cl. ..... 60/476; 60/478; 137/102

[58] Field of Search ..... 60/476, 478; 137/102

[56] References Cited

U.S. PATENT DOCUMENTS 4,557,180 12/1985 Glomeau ..... 137/102 X

*Primary Examiner*—Gerald A. Michalsky

*Attorney, Agent, or Firm*—Henry D. Pahl, Jr.

[57] ABSTRACT

The flow matching valve disclosed herein incorporates a fill port in addition to the source, load and respective drain ports employed in previous load matching valves. The inclusion of the fill port allows reconfiguration of hydraulic systems to reduce leakage and improve reliability and to eliminate auxiliary check valves in certain configurations.

3 Claims, 3 Drawing Sheets

FLOW MATCHING VALVE AND HYDRAULIC SYSTEM EMPLOYING SAME

RELATION TO OTHER APPLICATION

This application is a continuation-in-part of prior application Ser. No. 674,537 filed as PCT US84/00448 on Mar. 22, 1984, published as WO84/03916 on Oct. 11, 1984, now U.S. Pat. No. 4,696,163, which is a continuation-in-part of application Ser. No. 479,672 filed Mar. 8, 1983 now U.S. Pat. No. 4,557,180; and of application Ser. No. 479,673 filed Mar. 28, 1983 now U.S. Pat. No. 4,625,513.

BACKGROUND OF THE INVENTION

The present invention relates to flow matching valves and more particularly to such a valve which facilitates and simplifies the construction of hydraulic systems.

In the above-identified parent applications, there is described a flow matching control valve in which a piston is axially slidable within a sleeve, the sleeve and the piston having a first pair of mating valving surfaces and, axially spaced from the first pair, a second pair of mating valving surfaces, the two pair of valving surfaces being matched to open in synchronism. Passageways in the piston connect one pair of valving surfaces to one end of the piston and connect the other pair of valving surfaces to the other end of the piston. One end of the sleeve incorporates a valve seat and a valving member is provided which can mate with and close off the seat. The piston includes a portion which engages the valving member to lift it off the seat substantially at the same time that the mating valving surfaces open. In the sleeve, passageways are provided which connect each of the pairs of valving surfaces to respective drain ports.

BRIEF DESCRIPTION OF THE INVENTION

The present invention improves upon the above-described valve construction by providing a fill port which opens into the space between the piston and the valving member. The provision of this additional port substantially simplifies the construction of double acting hydraulic actuator systems employing the flow matching mode of operation and reduces leakage and improves reliability in single acting hydraulic actuator systems.

BRIEF DESCRIPITON OF THE DRAWINGS

Corresponding reference characters indicate corresponding parts throughout the several views of the drawings.

DESCRIPITON OF THE PREFERRED EMBODIMENTS

Figure 1:
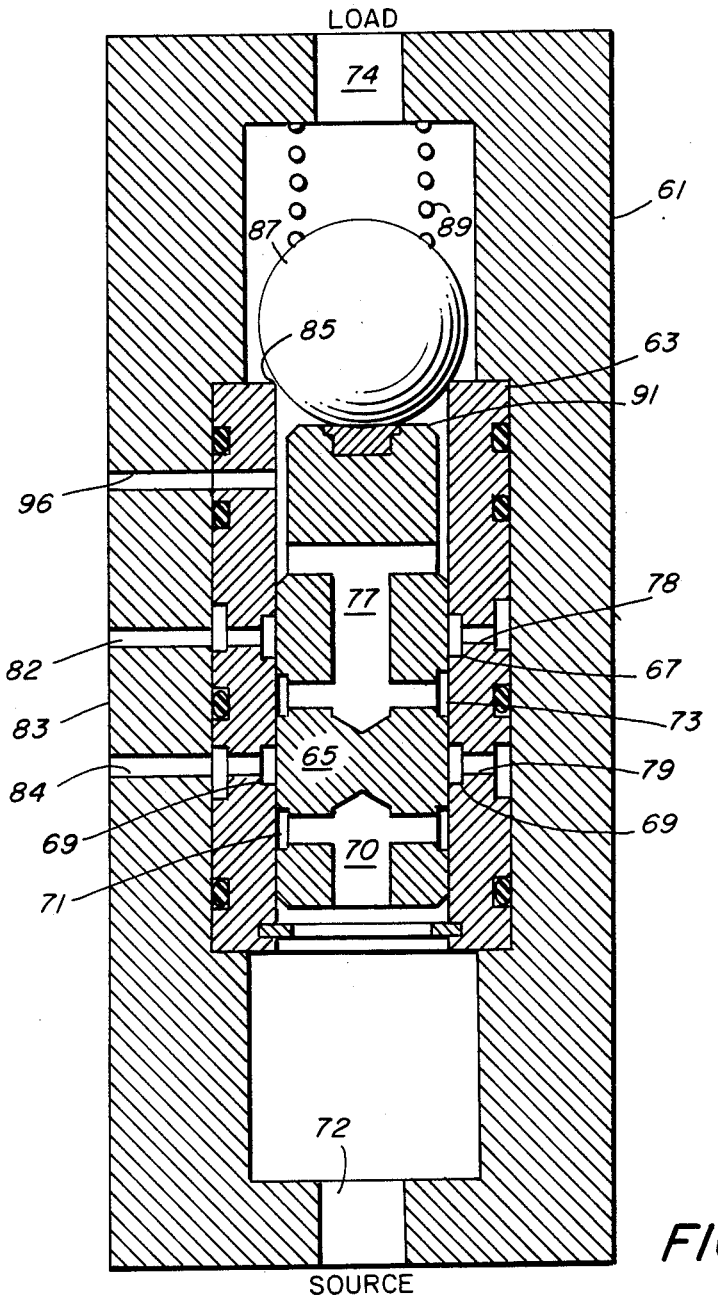
FIG. 1 is a side view, in section, of the improved flow matching control valve of the present invention.

In relating the modifications and improvements of the present invention to the earlier flow matching valve constructions described in the above-identified parent applications, it may be noted that FIG. 1 of the present application corresponds generally to FIG. 4 of application Ser. No. 674,537, now U.S. Pat. No. 4,696,163.

Fitting within an overall body assembly 61 is a sleeve 63 and a piston 65. Sleeve 63 is stationary within the body member 61 while the piston 65 is slidable axially within the sleeve 63, i.e. similar to the manner in which the spool element in a spool valve is slidable. Preferably, the piston is lapped to the sleeve to provide a close, low leakage fit. The sleeve 63 is provided with a pair of internal annular grooves 67 and 69 with a precise axial separation between them. The piston 65 is provided with a matching pair of external annular grooves 71 and 73, with an axial separation between these grooves which matches the axial separation between the grooves 67 and 69 on the sleeve.

With the piston 65 a first passageway system 70 connects the groove 71 with the source port 72 while a second passageway system 77 provides communication from the groove 73 to the end of the sleeve 63 nearest the load port 74. Cross ports 78 ard 79 in the sleeve connect the grooves 67 and 69, to a respective pair of drain ports 82 and 84 in the valve body 61. When employed in the system shown in FIG. 3, the drain ports 82 and 84 are connected together externally of the body 61 to form a common drain. However, in other systems, such as the double acting cylinder system described hereinafter with respect to FIG. 2, it is advantageous to utilize separate drain paths from the source and load with a pressure barrier, i.e. a sealed land, therebetween. These are referred to hereinafter as the source drain (84) and the load drain (82) respectively.

The upper end of the sleeve 63 provides a valve seat, as indicated by reference character 85 and a spherical valving element 87 is lightly biased into contact with this seat by a spring 89. A projecting portion 91 of the piston 65 is formed to lift the valving element 87 from the seat 85 just as the annular grooves on the piston come adjacent the respective annular grooves on the sleeve 63.

Ignoring for a moment the action of the spherical valving element 87, it can be understood that, as the pressure at the source port comes equal to that at the load port, the piston moves upwardly, opening the two valving sections in synchronism. If the drain ports are connected but closed, fluid flow introduced into the source port will proceed, through the drain ports, on to the load port. If the drain ports are open, however, matching flows from the source port and the load port will exit through the drain ports. These flows will be well matched in volume since the valve openings are closely matched and since the pressure drop in each channel will be equal.

This basic operation is not changed by the presence of the spherical valving element at the top of the sleeve since the spherical valving element 87 is lifted from the valve seat at the same time or slightly before the annular grooves open to each other. However, any time the source pressure drops significantly below the load pressure the spherical valving element acts as a simple but highly effective check valve eliminating backflow from the load. Since the desired sealing requirement is met by this element, there is no requirement for an absolute seal between the piston and the sleeve.

As thus far described, the valve of FIG. 1 is essentially the same as that shown in FIG. 4 of application Ser. No. 674,537, now U.S. Pat. No. 4,696,163. However, in accordance with the present invention, the improved valve incorporates an additional port 96, conveniently designated a fill port, which opens into the space between the piston 65 and the spherical valving element 87.

Figure 2:
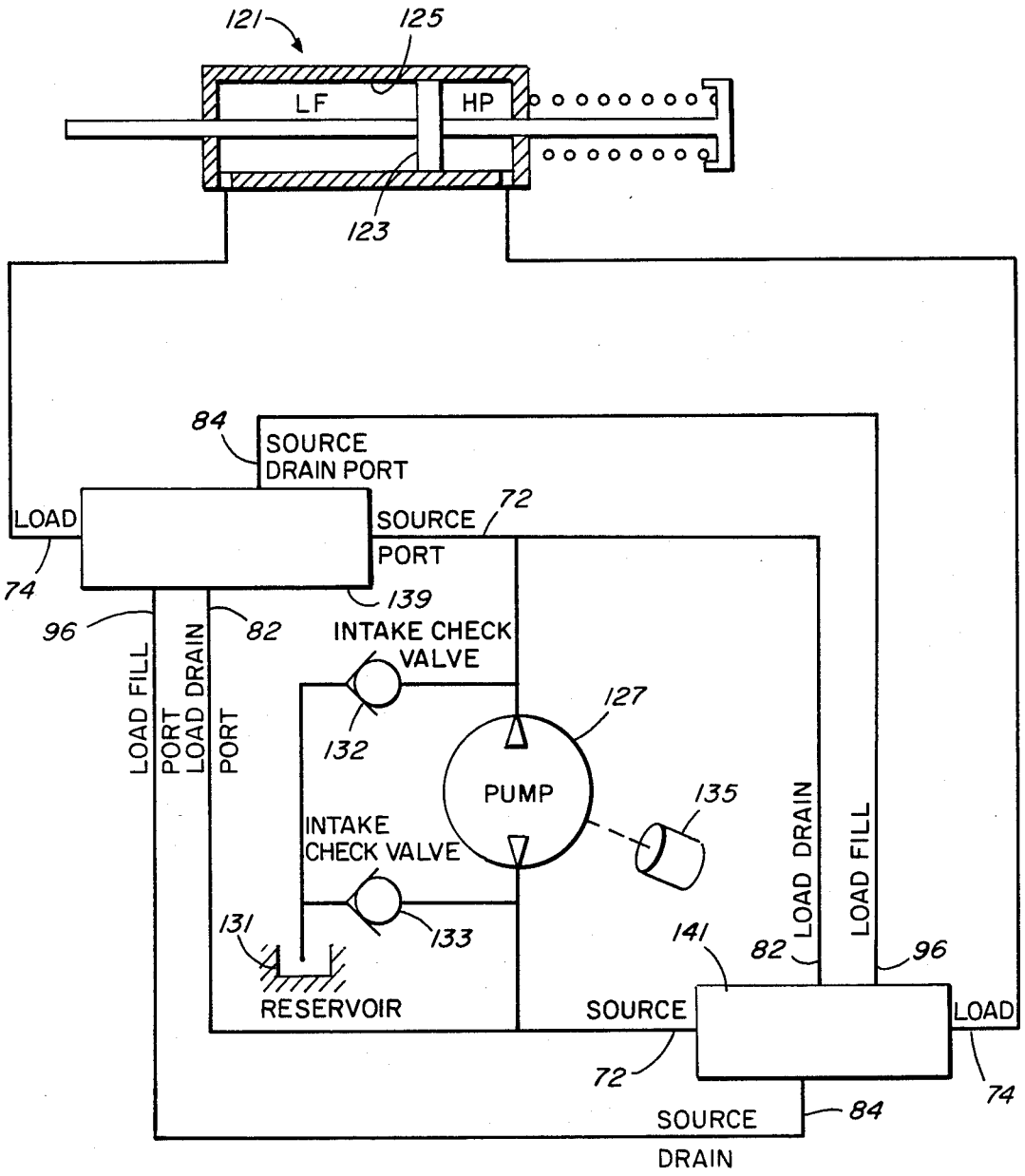
FIG. 2 is a diagrammatic illustration of a double acting hydraulic actuator system constructed in accordance with the present invention and employing the flow matching valve of FIG. 1.

The flow matching concepts of the present invention may also be advantageously applied to the control valving for a double acting or bidirectional hydraulic cylinder system if separate drain ports are utilized for the source and load ports. Referring now to FIG. 2, a prime mover is indicated generally by reference character 121 and comprises piston 123 and cylinder 125. The double rod ended piston provides equal annular area on both faces of the piston.

A bi-directional, positive displacement pump 127 is utilized for providing hydraulic fluid under a pressure suitable for operating the cylinder. A pressurized accumulator 131 provides a reservoir for the hydraulic fluid. This reservoir is connected through respective check valves 132 and 133 to both sides of the pump 127. Pump 127 is preferably of the positive displacement meshing gear type and is driven in either direction by a stepper motor 135 whose speed can be varied from zero to a maximum by means of suitable control electronics. Movement of the piston is tracked by a suitable transducer; e.g., a slide wire potentiometer so as to provide a suitable feedback voltage or signal.

One side of the pump, i.e. the upper side as shown in FIG. 2, is connected to one side of the cylinder 121 through a hydraulic circuit which includes the source/-source-drain path of a flow matching valve 139 and the fill/load path of a second flow matching valve 141. The other side of the pump 127 is symmetrically connected through a hydraulic circuit which includes the source/-source-drain path of the flow matching valve 141 and the fill/load path of the flow matching valve 139. Both flow matching valves 139 and 141 are identical in construction and size. The construction is preferably that illustrated in FIG. 1 with separate drain ports being maintained for the source and load ports.

The load-drain port 82 of each of the flow matching valves is cross connected to the source port 72 of the other flow matching valve. In the following description of operatior, it is assumed that a load is being applied to the piston 123 from the left side so that the right side of the cylinder is under greater pressure than the left side.

While the hydraulic system of FIG. 2 is in many ways similar to the hydraulic system shown in FIG. 7 of application Ser. No. 674,537, now U.S. Pat. No. 4,696,163, it may be noted that the inclusion of the fill port 96 in each of the flow matching valves has allowed the simplification of the arrangement by the elimination of two check valves, these valves being designated by reference characters 145 and 147 in FIG. 7 of the '537 application.

In order to drive the piston against the load, the pump 127 is driven so as to produce a flow upwardly as seen in the drawing of FIG. 2. When the pressure at the outlet of the pump exceeds that of the low pressure side of the cylinder, the piston of the flow matching valve 139 will move to the left and lift the valving element. Under continued pumping, flow from the source drain of control valve 139 enters the load fill port 96 of the control valve 141 which pressurizes the region between the respective piston and valving element. The piston moves to the extreme left position assuring closure of the source drain and load drain ports in the control valve 141. When the pump output pressure reaches that on the high pressure side of the piston, the valving element will lift. Under continued pumping, flow will then occur through the source/source-drain path of the valve 139 and the fill/load path of the valve 141, driving the piston to the left. At the same time, an equal flow will return from the left side of the piston through the load/load-drain path of the control valve 139 back to the low pressure side of the pump.

When the pump 127 is operated in the opposite direction, i.e. producing downwardly as seen in FIG. 2, an essentially similar operation takes place but additional flow matching effects may come into play. Initially, when the pump output pressure reaches that on the high pressure side of the cylinder, the piston on the valve 141 will move to the right, lifting the valving element. Flow from the source drain 84 of the control valve 141 enters the load fill port 96 of the control valve 139 which pressurizes the region between the respective piston and valving element to a pressure equal that of the low pressure side of the cylinder. A flow will pass through the source/source-drain path of the valve 141 and the fill/load path of the valve 139 to fill the expanding low pressure side of the piston. Flow from the right side of the piston passes through the load/load-drain path of the valve 141 allowing the piston to move to the right. If for any reason the flow from the right or high pressure side of the cylinder increases the pressure on the low pressure side of the pump 127, the increased pressure would move the piston of the flow matching valve 139 to the left opening the source/source-drain path and the load-drain/load path. A portion of the pump flow would then pass through the load-drain/load path of the flow matching valve 139 thereby decreasing flow resistance and thus decreasing the pressure at the source port 72 of the flow matching valve 141. The decreasing pressure would move the piston of the flow matching valve 141 to the left thereby throttling the flow through the load drain port 82 and decreasing the pressure on the lot pressure side of the pump 127. This pressure compensation results in precise control of the release of high pressure fluid from the cylinder 121.

Since the hydraulic circuit is entirely symmetrical, it can be seen that complementary actions are obtained if the load is applied to the piston in the opposite direction. An additional advantage of the symmetrical design of FIG. 7 is that, when the pump is stopped, the high pressure trapped under the plug of the active valve 131 will cause the passive valve plug to lift and relieve the said trapped pressure which would otherwise delay the closing of the high pressure load port causing the piston to creep. In addition, the pump is unloaded and ready for the next start thereby substantially eliminating any risk of the motor stalling.

Summarizing, it can be seen that the flow pumped into one side of the cylinder is always matched by the flow returned to the pump intake regardless of the direction of rotation of the pump and regardless of the direction of the load. Further, since this hydraulic circuit is entirely symmetrical, it follows that the high pressure and low pressure sides of the cylinder are only dictated by the direction of the load vector. Conversely, the response or sensitivity of the actuator is identical in both directions regardless of the direction of the load, a highly desirable attribute as will be understood by those skilled in the servo control art.

Figure 3:
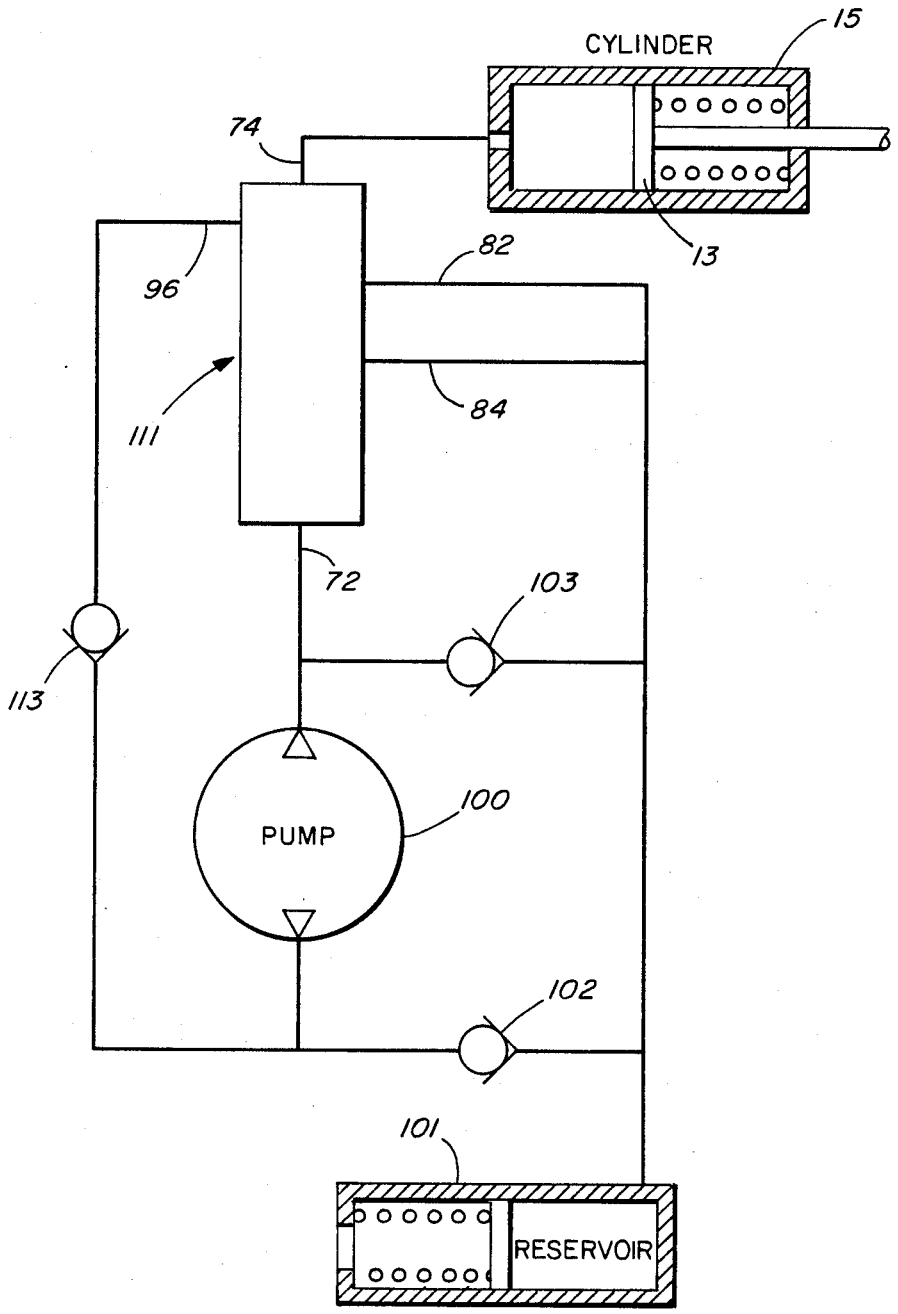
FIG. 3 is a diagrammatic illustration of a single acting hydraulic actuator system constructed in accordance with the present invention and employing the flow matching valve of FIG. 1.

FIG. 3 illustrates a single acting actuator system which also benefits from the inclusion of the original fill port in the valve of FIG. 1. The arrangement of FIG. 3 is similar to that shown in FIG. 5 of the '537 application.

Referring now to FIG. 3, a bidirectional positive displacement pump 100 is utilized for providing hydraulic fluid under a pressure suitable for operating a single acting hydraulic cylinder, indicated by reference character 15. A pressurized accumulator 101 provides a reservoir of hydraulic fluid. This reservoir is connected, through respective check valves 102 and 103, to both sides of pump 100. Pump 100 is preferably of the positive displacement, meshing gear type and is driven in either direction by a stepping motor. Movement of the piston 13 may be tracked by a suitable transducer, e.g. a slide wire potentiometer, so as to provide a suitable feedback signal or voltage. One side of the pump 100 is connected to the source port 72 of a flow matching valve 111 of the type illustrated in FIG. 1. The cylinder 15 is connected to the load port 74 of the flow matching valve 111. Both of the drain ports 82 and 84 are connected directly back to the reservoir 101 and the fill port 96 is connected to the other side of the pump 100 through a check valve 113.

The advantage of the arrangement of FIG. 3 as compared with that shown in FIG. 5 of the '537 application is that the check valve 113 is, in effect, in series with the valving element in the flow matching valve 111 whereas it was essentially in parallel with the check valving of the flow matching valve 31 in the embodiment shown in FIG. 5 of the '537 application. As will be understood by those skilled in the art, the serial connection of check valves will provide reduced leakage and improved reliability as compared with an arrangement which effectively puts the valves in parallel so that any leakages are additive.

In view of the foregoing, it may be seen that several objects of the present invention are achieved and other advantageous results have been attained.

As various changes could be made in the above constructions without departing from the scope of the invention, it should be understood that all matter contained in the above description or shown in the accompanying drawings shall be interpreted as illustrative and not in a limiting sense.

What is claimed is:

1. A control valve comprising;

a generally tubular sleeve;

a piston axially slidable within said sleeve, said sleeve and piston having a first pair of mating valving surfaces and, axially spaced from said first pair, a second pair of mating valving surfaces, said valving surfaces being matched to open in synchronism;

in said piston, a first passageway from said first valving surface to one end of said piston and a second passageway opening from said second valving surfaces to the other end of said piston;

in said sleeve, passageways connecting each set of said valving surfaces to respective drain ports;

at one end of said sleeve, a valve seat;

a valving member adapted to mate with and close off said seat, said piston including a portion which, during movement of the piston, engages said valving member to lift it off said seat substantially at the same time that said mating valving surfaces open; and in said sleeve, separate from said drain ports, a fill port connecting into the space between said valving member and said piston.

2. A hydraulic system comprising:

a fluid reservoir;

a bidirectional pump;

a double acting piston and cylinder having first and second ports accessing opposite sides of the piston;

a pair of flow matching control valves each having a generally tubular body, a source port at a first axial position along said body, a load port at a second position along said body which is axially spaced from said first position, and, in said body, an axially floating piston member which is movable axially responsive to any difference in the pressures at said source and load ports, said body including rigidly connected mating surfaces which progressively open said source and load ports to respective drain ports in synchronism;

at one end of each of said tubular bodies, a valve seat;

respective valving members adapted to mate with and close off each of said seats, each of said piston members including a portion which, during motion of the piston member, engages the respective valving member to lift it off the respective seat substantially at the same time as the respective source and load ports open;

each of said tubular bodies including a fill port, separate from the drain ports, opening into the space between the respective valving member and the respective piston;

means connecting said reservoir to both sides of said pump through respective check valves permitting flow from the reservoir toward the pump;

means connecting each side of said pump to the source port of a respective control valve;

means connecting the load port of each control valve to a respective one of said cylinder ports;

means connecting the load drain port of each control valve to the source port of the other control valve; and means connecting the source drain of each control valve to the fill port of the other control valve.

3. A hydraulic system comprising:

a fluid reservoir;

a bidirectional pump;

a variable volume load having an inlet port, said load being moved in one direction by the introduction of fluid through said inlet port and being moved in the opposite direction by the withdrawal of fluid from said inlet port;

a flow matching control valve having:

a generally tubular sleeve;

a piston axially slidable within said sleeve, said sleeve and piston having a first pair of mating valving surfaces and, axially displaced from said first pair, a second pair of mating valving surfaces, said valving surfaces being matched to open in synchronism;

in said piston, a first passageway from said first valving surface to one end of said piston to connect with a source port and a second passageway opening from said second valving surfaces to the other end of said piston;

passageways connecting each set of said valving surfaces to said reservoir;

at one end of said sleeve, a valve seat;

a valving member adapted to mate with and close off said seat, said piston including a portion which, during movement of the piston, engages said valving member to lift it off said seat substantially at the same time that said mating valving surfaces open;

in said sleeve, separate from said drain passageways, a fill port connecting into the space between said valving member and said piston;

means connecting said reservoir to both sides of said pump through respective check valves permitting flow from the reservoir toward the pump;

means connecting one side of said pump to the source port of said control valve;

means connecting the load port of said control valve to the inlet port of said load;

means connecting the drain port of said control valve to said reservoir; and means connecting the other side of said pump to the fill port of said control valve through a check valve permitting flow from said pump toward said load.

* * * * *